US007441306B2

(12) United States Patent
Kim

(10) Patent No.: US 7,441,306 B2
(45) Date of Patent: Oct. 28, 2008

(54) VACUUM CLEANER AND SUCTION NOZZLE STRUCTURE THEREOF

(75) Inventor: Kyung Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 615 days.

(21) Appl. No.: 11/099,577

(22) Filed: Apr. 6, 2005

(65) Prior Publication Data

US 2006/0042041 A1 Mar. 2, 2006

(30) Foreign Application Priority Data

Aug. 30, 2004 (KR) ..... 10-2004-0068378

(51) Int. Cl.
*A47L 5/30* (2006.01)
*A47L 9/04* (2006.01)

(52) U.S. Cl. ..... 15/383; 15/334; 15/387

(58) Field of Classification Search ..... 15/334, 15/387, 383, 422; *A47L 5/30, 9/04*
See application file for complete search history.

(56) References Cited

U.S. PATENT DOCUMENTS 3,704,482 A * 12/1972 Brannon ..... 15/387
4,426,751 A * 1/1984 Nordeen ..... 15/384
5,008,973 A * 4/1991 Worwag ..... 15/387
6,018,845 A * 2/2000 Sueki et al. ..... 15/383
6,539,577 B1 * 4/2003 Okuda et al. ..... 15/383
7,281,297 B2 * 10/2007 Peacock et al. ..... 15/384
2006/0026788 A1 * 2/2006 Fischer et al. ..... 15/334

* cited by examiner

*Primary Examiner*—Theresa T Snider
(74) *Attorney, Agent, or Firm*—Ked & Associates LLP

(57) ABSTRACT

Provided is a suction nozzle structure of a vacuum cleaner for enhancing a foreign particle suction efficiency. The suction nozzle structure includes: a suction tube in which a negative pressure is formed; a suction hole formed at a bottom of the suction nozzle structure such that air and foreign particles are sucked by the negative pressure of the suction tube; an agitator installed at an upper side of the suction hole; an air guide provided with an air suction passage communicating the suction hole with the suction tube, for guiding air flow; and a foreign particle rotation-preventing portion formed protruding from the air guide, for preventing a foreign particle from rotating.

23 Claims, 7 Drawing Sheets

VACUUM CLEANER AND SUCTION NOZZLE STRUCTURE THEREOF

BACKGROUND OF THE INVENTION

1. Field of the Invention

The present invention relates to a vacuum cleaner, and more particularly, to a suction nozzle of the vacuum cleaner that provides improved suction efficiency. Further, the present invention relates to a suction nozzle structure of an upright vacuum cleaner that can improve suction efficiency of foreign particles under the condition of the same suction amount by efficiently sucking the foreign particles.

2. Description of the Related Art

A vacuum cleaner is generally classified into a canister vacuum cleaner and an upright vacuum cleaner. Particularly, the upright vacuum cleaner includes a main body, a nozzle unit and a handle that are integrally formed, so the vacuum cleaner itself is moved when a user pushes or pulls a handle with gripping it. At this time, dusts on the floor are sucked through the nozzle to clean the floor. A general configuration of such an upright vacuum cleaner is already well known in many documents.

Meanwhile, the upright vacuum cleaner has a limitation in cleaning the whole indoor space due to its own shape. In more detail, since the upright vacuum cleaner has the main body, the main nozzle unit and the handle integrated and the whole vacuum cleaner moves at the same time during the cleaning process, it has many restrictions in view of space to be cleaned. For example, the main nozzle of the upright vacuum cleaner cannot reach a corner or an edge of such as a stairway, the corner or edge cannot be cleaned. In order to solve this problem, there had been proposed an upright vacuum cleaner in which only a hose may be separated from the suction nozzle body and then a mini nozzle is connected to an end of the separated hose. That is to say, with the main body of the upright vacuum cleaner being placed at its original position, the mini nozzle is connected to the end of the suction hose and a user cleans corners and edges with moving only the mini nozzle.

Meanwhile, the mini nozzle has a small size, which results in a low suction efficiency of air. Thus, in order to completely absorb foreign particles attached on a bottom surface, the mini nozzle requires an essential use of an agitator. The agitator provides an advantage that the foreign particles on the bottom surface are completely scratched off and are sucked. However, when there occurs a phenomenon that the sucked air hovers about the agitator together with the foreign particles, the suction efficiency of the foreign particles is lowered. In other words, the foreign particles may rotate along with a flow of air rotating around the agitator or the foreign particles hovering together with air may be again exhausted to an outside through the suction hole. In such a circumstance, the cleaning efficiency is lowered, which is not preferable.

Also, if the foreign particles are not guided in an exact direction inside the mini nozzle, the foreign particles are stacked, which results in frequent cleaning of the inside of the mini nozzle.

SUMMARY OF THE INVENTION

Accordingly, the present invention is directed to an upright vacuum cleaner that substantially obviates one or more problems due to limitations and disadvantages of the related art.

An object of the invention is to provide a suction nozzle structure of a vacuum cleaner that can prevent foreign particles from rotating due to the air rotating around the agitator to improve a use efficiency of the vacuum cleaner.

Another object of the invention is to provide a suction nozzle structure of a vacuum cleaner that can prevent the suction nozzle from being contaminated by rapidly sucking foreign particles into the inside of the suction nozzle such that the foreign particles are not accumulated inside the suction nozzle.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a suction nozzle structure of a vacuum cleaner, which includes: a suction tube in which a negative pressure is formed; a suction hole formed at a bottom of the suction nozzle structure such that air and foreign particles are sucked by the negative pressure of the suction tube; an agitator installed at an upper side of the suction hole; an air guide provided with an air suction passage communicating the suction hole with the suction tube, for guiding air flow; and a foreign particle rotation-preventing portion formed protruding from the air guide, for preventing a foreign particle from rotating.

In another aspect of the invention, there is provided a vacuum cleaner, which includes: a suction nozzle unit through which outer air is sucked; a body in which a dust collecting unit is at least received and through which foreign particles introduced through the suction nozzle unit are filtered; a hose for connecting the suction nozzle unit with the body to guide air flow; a manipulation handle formed on an upper portion of the body and used for manipulating the vacuum cleaner; a mini nozzle selectively connected to the hose and used in cleaning; a mini nozzle seat concavely formed at a predetermined portion of the body such that the mini nozzle is selectively received therein; an agitator received in the mini nozzle, for making foreign particles come off a bottom by a rotation thereof and be sucked; and a foreign particle rotation-preventing portion extending toward the agitator such that the foreign particles received in a rotational turbulent flow around the agitator are prevented from rotating.

In still another aspect of the invention, there is provided a suction nozzle structure of a vacuum cleaner, which includes: upper cover and lower cover forming an outer shell of a mini nozzle; an agitator receiving portion in which an agitator for making foreign particles come off a bottom is received; a turbine receiving portion formed at a rear side of the agitator receiving portion and in which a turbine rotated by an air flow is received; an air guide partitioning a space of the mini nozzle into the agitator receiving portion and the turbine receiving portion and guiding air sucked by the agitator receiving portion to the turbine receiving portion; and a foreign particle rotation-preventing portion formed protruding from the air guide, for preventing a foreign particle from rotating.

By employing the supposed configuration, the cleaning efficiency of the vacuum cleaner can be improved. Also, since the use time of the vacuum cleaner for the cleaning can be reduced, power consumption can be decreased.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. However, the spirit of the invention is not limited to the embodiments, but those skilled in the art might easily propose other embodiments by adding, changing, deleting or modifying components within the scope of the invention.

Figure 1:
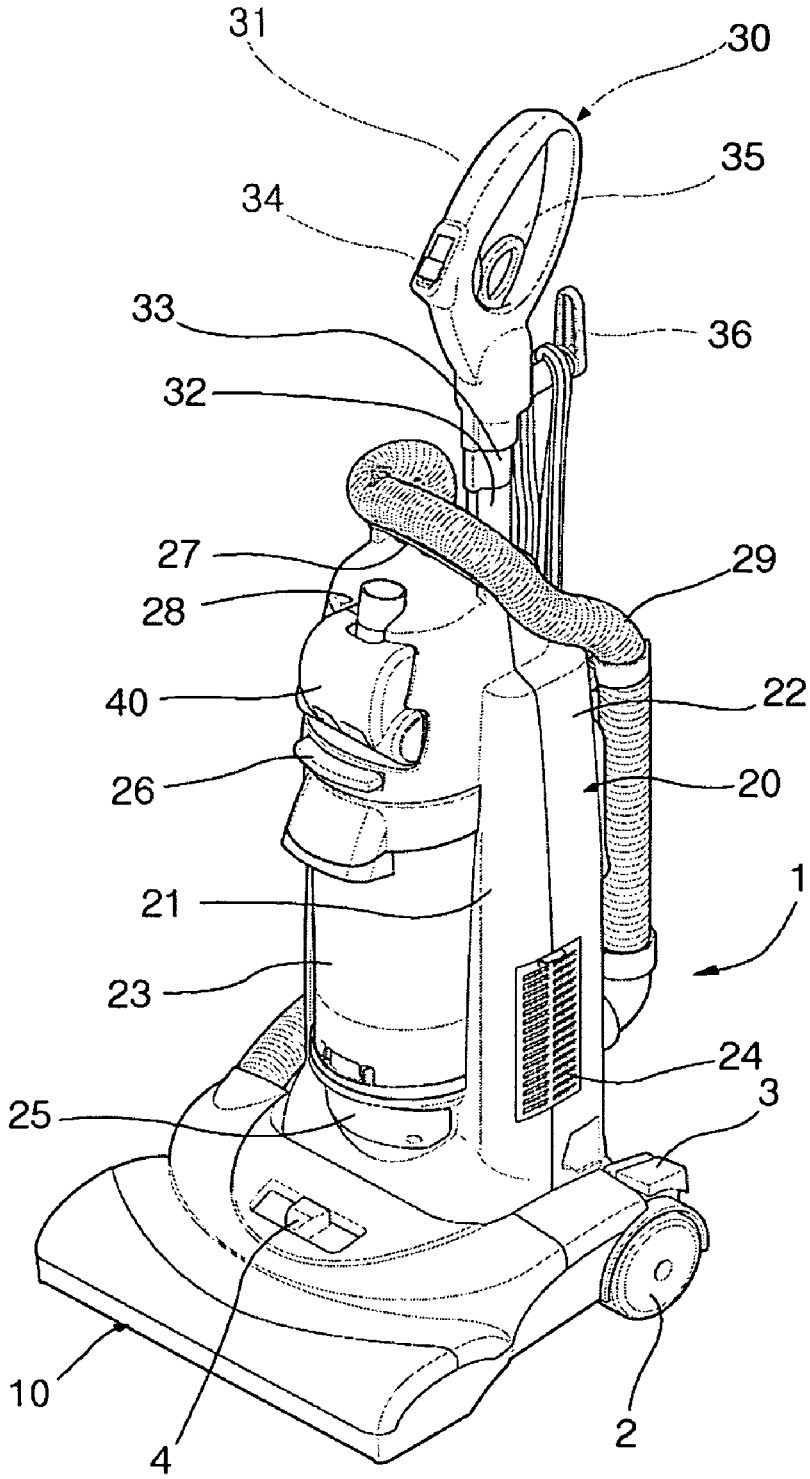
FIG. 1 is a front perspective view showing an upright vacuum cleaner according to the present invention.
Figure 2:
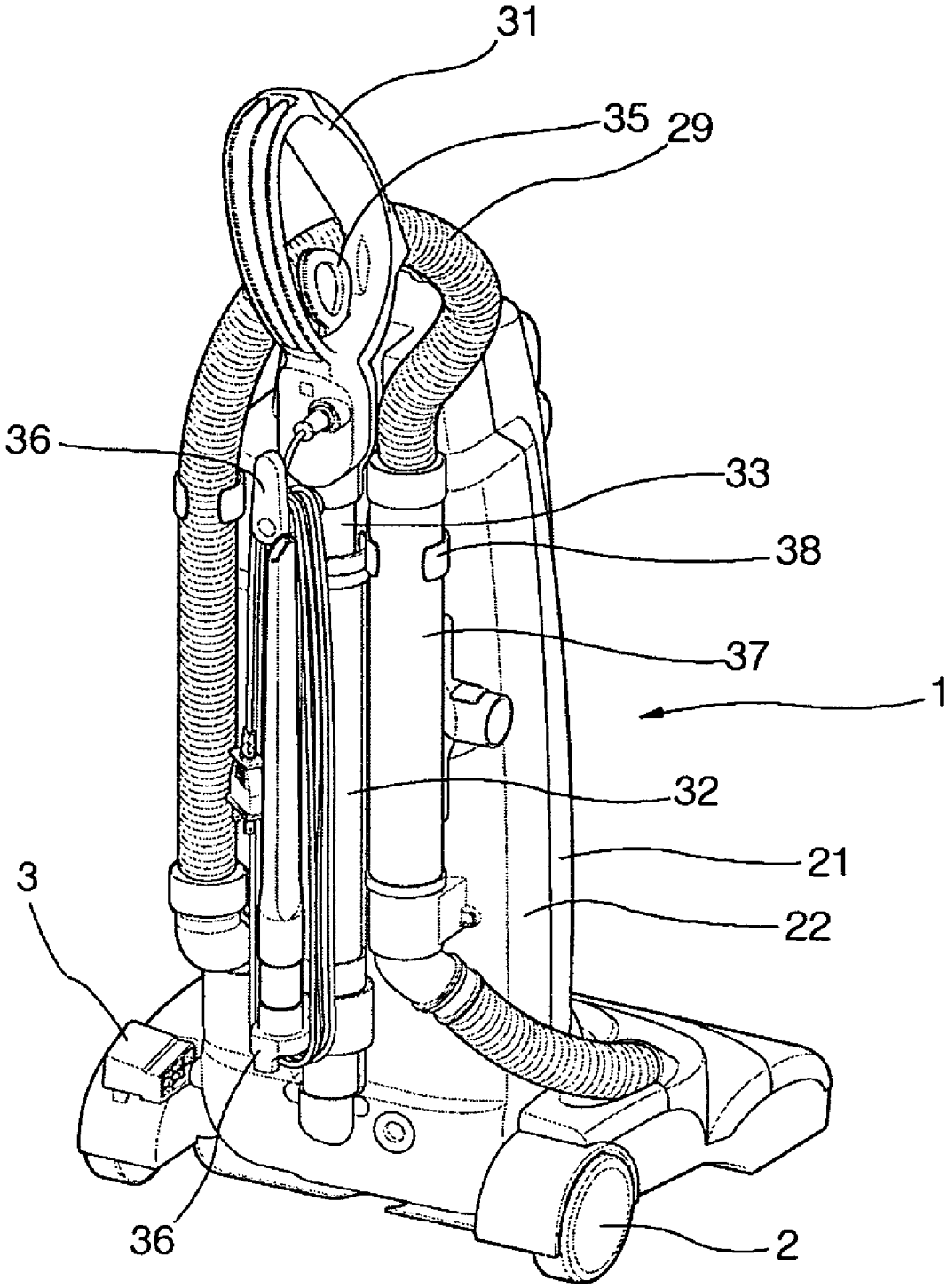
FIG. 2 is a rear perspective view showing an upright vacuum cleaner according to the present invention.

FIG. 1 is a front perspective view of an upright vacuum cleaner according to the present invention, and FIG. 2 is a rear perspective view of the upright vacuum.

Referring to FIGS. 1 and 2, the upright vacuum cleaner 1 of the present invention macroscopically includes a suction nozzle unit 10 contacted with a floor, for sucking an outer air, a body 20 in which main parts such as a suction motor and a fan are mounted, and a manipulation handle 30 formed on an upper portion of the vacuum cleaner such that the vacuum cleaner is moved in an easy way during the cleaning work. The cleaning work using the vacuum cleaner is conducted as follows. First, air is sucked through the suction nozzle unit 10 together with foreign particles. The foreign particles are separated from the sucked air while passing through the body 20 so that the sucked air is cleaned, and then the cleaned air is exhausted. In addition, in order to move the vacuum cleaner to a desired position, a user grips the manipulation handle 30 of the vacuum cleaner and then pulls or pushes the vacuum cleaner.

In detail, the suction nozzle unit 10 is used for sucking an outer air and has a substantially rectangular shape with an opening opened toward the floor. The suction nozzle unit 10 is hinged to the body 20, and a pivoting lever 3 controls this binge movement. In addition, for better movement of the suction nozzle unit 10, wheels 2 are installed at a rear portion of the suction nozzle unit 10, and a height control knob 4 is installed on an upper surface of the suction nozzle unit 10 for height control of the suction nozzle unit 10. The air sucked into the suction nozzle unit 10 is guided to the body 20 by means of a hose 29. For this purpose, both ends of the hose 29 are respectively connected to the suction nozzle unit 10 and the body 20.

In detail, the body 20 includes a front case 21 for protecting a front portion of the body and a rear case 22 for protecting a rear portion of the body, and the front and rear portions are fixed to each other by a certain manner such as fitting or screwing. Furthermore, the body 20 is provided with a dust collecting unit 23 for collecting dusts from the air sucked through the hose 29, a detachable lever 26 for separating the dust collecting unit 23 from the body 20 in a convenient way, a discharge cover 24 formed in a side of the body for allowing the air free from foreign particles to be discharged, a lamp 25 for giving a light to the floor at night so that the vacuum cleaner may be manipulated in a convenient way, a mini nozzle seat 28 depressed in the top of the front case 21, and a mini nozzle 40 selectively received in the mini nozzle seat 28. The mini nozzle 40 can be used for cleaning a place that is not directly contacted with the main body of the upright cleaner like a corner and received in the mini nozzle seat 28 during a custody time. The mini nozzle 40 will be described in more detail later.

In addition, the body 20 is also provided with, on its rear side, a cord hook 36 protruded at upper and lower positions of the body 20 such that a power line is wound kept in custody thereon, a hose guide 37 that configures at least a part of the hose 29 and is made of strong materials unlike the hose 29, and a holder 38 protruded on the rear side of the body 20 so as to support the hose guide 37. The hose guide 37 is used for convenient positioning of the mini nozzle 40 when the mini nozzle is used in connection to the hose 29. Meanwhile, the hose 29 is shaped in an expandable bellows tube of which length is freely increased or decreased. So, when the mini nozzle 40 is connected for use, it can move to a distant place from the main body. For this purpose, since the hose 29 has a bellows shape, its length is shortened while being kept in custody and elongated over several times when being used by a user.

In addition, at the top of the front case 21, the hose 29 may be seated in a shrunk state, and a carrying handle 27 is formed for a user to grip to carry the vacuum cleaner. The carrying handle 27 may be used not only for holding and carrying the vacuum cleaner but also for holding the hose 29.

In detail, the manipulation handle 30 includes a handle grip 31 for a user to grip conveniently while the vacuum is operating, and an operation switch 34 formed at a predetermined position of the handle grip 31 and used for controlling operation of the vacuum cleaner such as On/Off of operation of the vacuum switch and adjustment of a suction force of the vacuum cleaner. In addition, a length of the manipulation handle 30 may be conveniently adjusted. In more detail, for adjustment of length, the manipulation handle 30 includes an extension pipe 33 extended below the handle grip 31, and a fixed pipe 32 that supports the extension pipe 33 and allows the extension pipe 33 to be moved through it by means of selective manipulation of an extension lever 35 so that the length of the manipulation handle 30 may be shortened or elongated.

Among the components of the vacuum cleaner, the present invention has a main interest on the mini nozzle 40, particularly on structural improvement of the mini nozzle 40 enabling an enhancement of cleaning efficiency using the mini nozzle 40. Thus, the suction nozzle structure of the vacuum cleaner according to the present invention is not limited to the upright vacuum cleaner shown in FIGS. 1 and 2, but may be employed in a canister vacuum cleaner or other kinds of suction nozzles in an easy way. More preferably, the suction nozzle structure of the present invention is employed in the upright vacuum cleaner.

Figure 3:
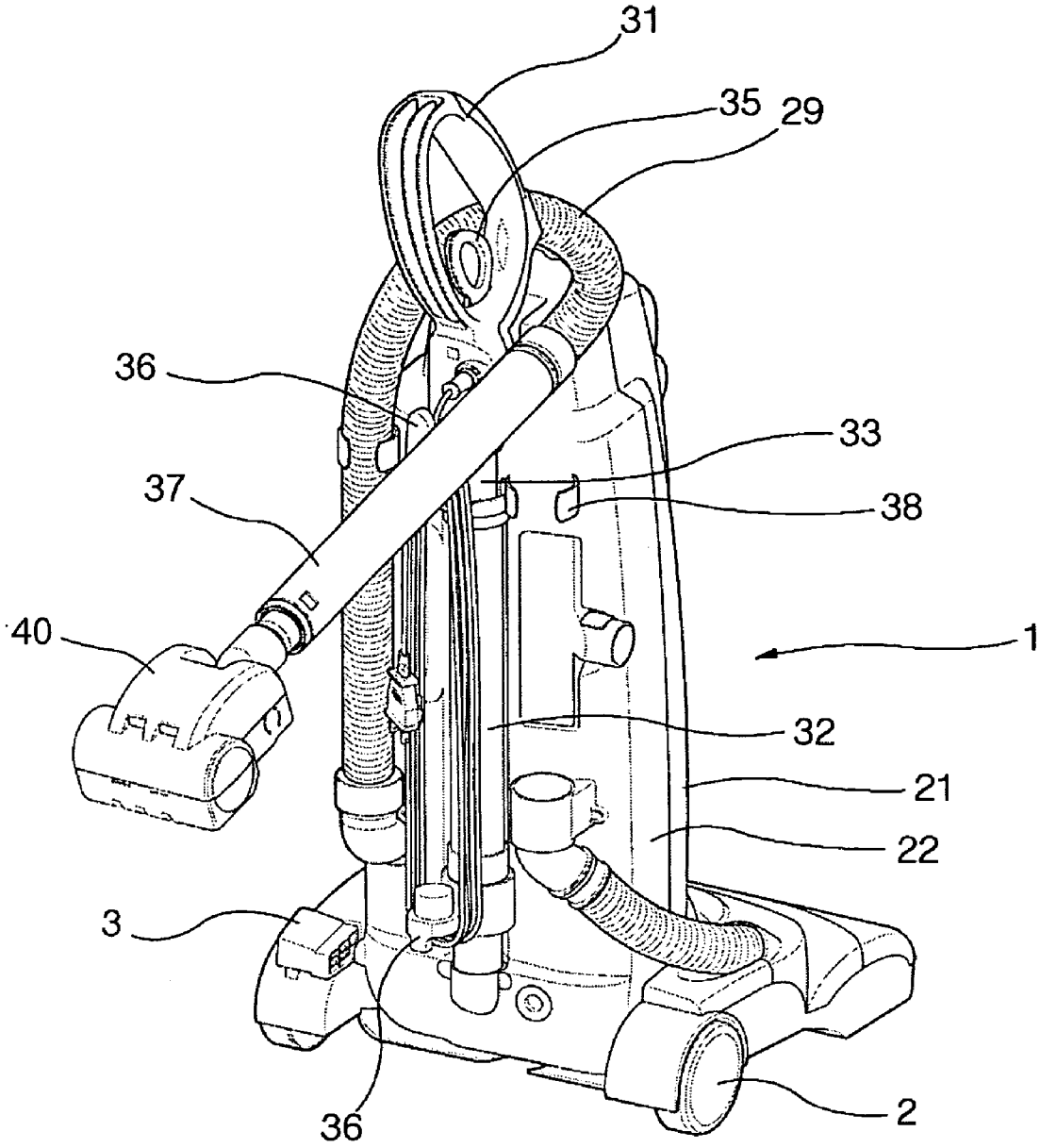
FIG. 3 is a perspective view showing a used state of a mini nozzle of an upright vacuum cleaner according to the present invention.

FIG. 3 is a perspective view illustrating a used state of the mini nozzle.

Referring to FIG. 3, the mini nozzle 40 is separated from the mini nozzle seat 28 and then connected to the hose guide 37. Thus, with the body 20 of the vacuum cleaner being fixed, a user may clean a room with moving just the hose 29 and the hose guide 37. In other words, while the vacuum cleaner 1 is fixed to a position, the mini nozzle 40 is used for cleaning with moving the hose 29. In particular, the mini nozzle 40 has a small size, so it may be conveniently used for cleaning a place such as a corner or a stairway that is not easily cleaned by the vacuum cleaner.

Figure 4:
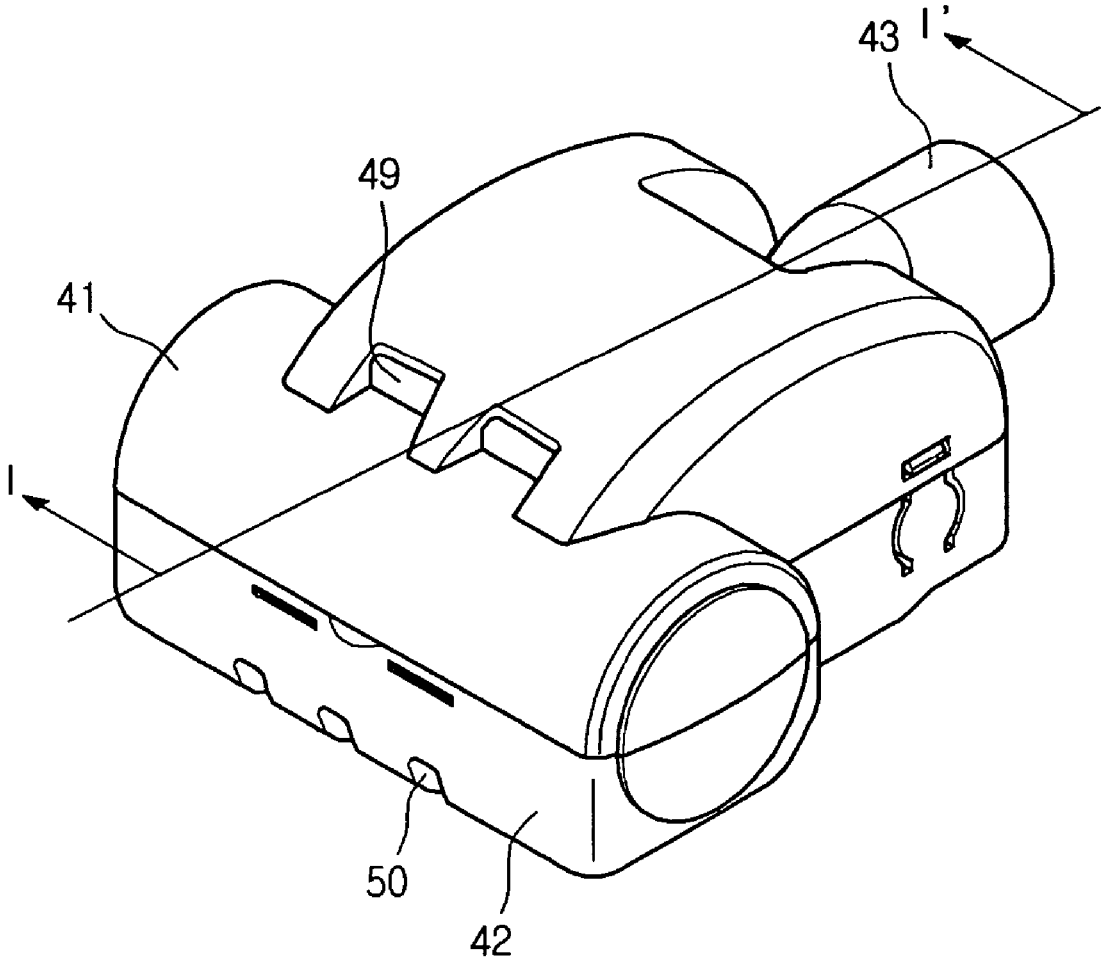
FIG. 4 is a perspective view of a mini nozzle adopted in an upright vacuum cleaner according to the present invention.
Figure 5:
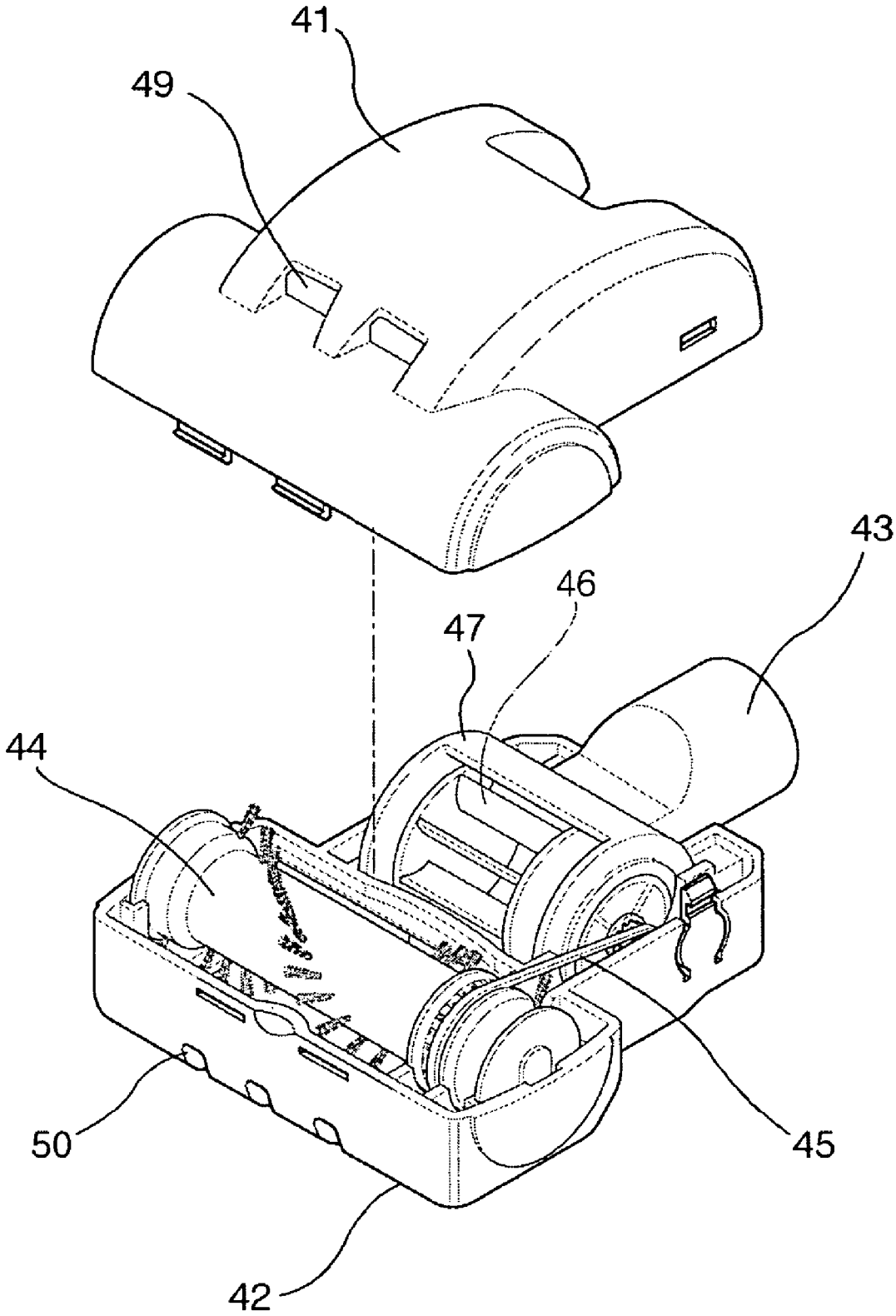
FIG. 5 is a perspective view of a mini nozzle at a state where an upper cover is separated from a suction nozzle according to the present invention.

FIG. 4 is a perspective view of a mini nozzle according to the present invention, and FIG. 5 is a perspective view of a mini nozzle whose upper cover is separated from the suction nozzle.

Referring to FIGS. 4 and 5, the mini nozzle 40 according to the spirit of the present invention includes an upper cover 41 for protecting an upper portion of the mini nozzle 40, a lower cover 42 for protecting a lower portion of the mini nozzle 40, and a suction tube 43 for sucking an air discharged from the mini nozzle 40 into the hose guide 37. In addition, the mini nozzle 40 includes, in its inner place, an agitator 44 mounted at a front portion of the mini nozzle 40 to float dusts on the floor during its revolution for improved cleaning efficiency, a turbine housing 47 mounted to an inner end of the suction tube 43, a turbine 46 having a central shaft guided inside the turbine housing 47 and rotated by the air flowing in the turbine housing 47, and a belt 45 connecting the turbine 46 and the agitator 44 to rotate the agitator 44.

In addition, a suction hole (see 51 of FIG. 6) for sucking air on the floor is formed in a lower surface of the lower cover 42. A bypass channel is also formed such that air is bypassed and sucked when the suction hole (not shown) is blocked by a flexible member such as a carpet. In detail, the bypass channel includes a first bypass channel 50 formed at a lower edge of a front surface of the lower cover 42, and a second bypass channel 49 formed in an upper surface of the upper cover 41. By the bypass channels 49 and 50, air is bypassed and sucked into the mini nozzle 40, thereby preventing a motor in the body of the vacuum cleaner from being overheated.

Figure 6:
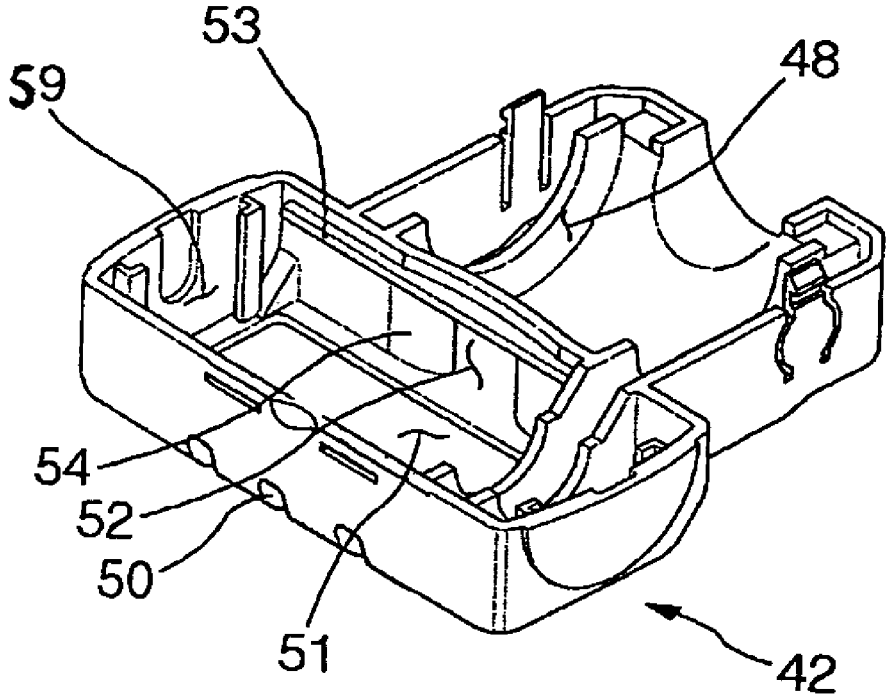
FIG. 6 is a front perspective view of a lower cover.

FIG. 6 is a front perspective view of the lower cover. An inner configuration of the mini nozzle 40 will be described in detail with reference to FIG. 6.

Referring to FIG. 6, the lower cover includes a turbine receiving portion 48 in which the turbine 46 is received; an agitator receiving portion 59 in which an agitator 44 is received, and an air guide 54 partitioning an inner space of the lower cover 42 into the agitator receiving portion 59 and the turbine receiving portion 48 and guiding air from the agitator receiving portion 59 to the turbine receiving portion 48.

The lower cover 42 further includes the suction hole 51 formed at a lower side of the agitator receiving portion 59, through which air is sucked, a suction passage 52 formed at an approximately central portion of the air guide 54, for letting air sucked in a rapid speed toward the turbine 46, and a foreign particle rotation-preventing portion 53 formed protruding in a lateral direction from an upper edge of the air guide 54. The air guide 54 is inclined backward as it travels to a central portion thereof such that air containing foreign particles is guided to the suction passage 52. The foreign particle rotation-preventing portion 53 may be a rib formed in a lateral direction at an upper side of the air guide 54.

Referring to FIGS. 4 and 5, operation and function of the mini nozzle according to the spirit of the present invention will be described. If negative pressure is generated in the suction tube 43, air is strongly sucked through the suction hole 51. Of course, the suction tube 43 is connected to the main body of the vacuum cleaner by means of the hose 29 to communicate with a suction fan (not shown) of the main body so that negative pressure may be generated. In addition, together with the air sucked through the suction hole, foreign particles on the floor are rapidly sucked toward the suction passage 52. The rapid airflow passing through the suction passage 52 rotates the turbine 46, and is then introduced into the main body of the vacuum cleaner via the suction tube 43. In addition, since the rotational axis of the turbine 46 is connected with the rotational axis of the agitator 44 by the belt 45, the agitator 44 rotates when the turbine 46 rotates. If the agitator 44 rotates, dusts on the floor are floated, thereby improving the cleaning efficiency.

When the suction hole 51 is blocked, air can be bypassed and sucked into the suction nozzle 40 through the first and/or second bypass channel 50 and/or 49, so the suction motor (not shown) mounted in the vacuum cleaner can be prevented from being overheated.

Operation of the mini nozzle will now be sequentially described with reference to the sectional view of FIG. 7 taken along the line I-I' of FIG. 4 centering on airflow direction.

Figure 7:
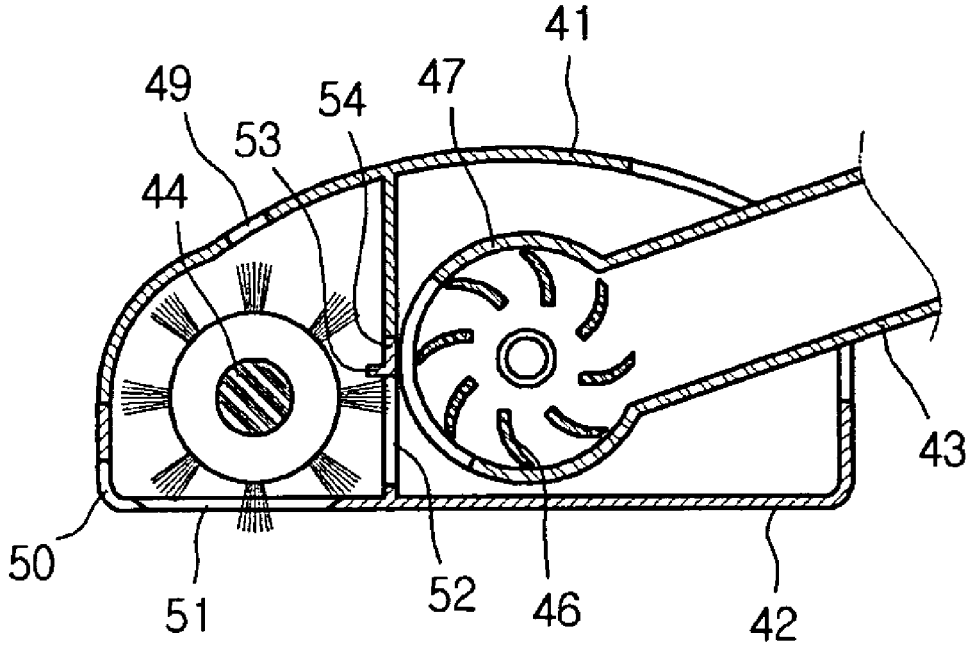
FIG. 7 is a sectional view taken along the line I-I' of FIG. 4.

Referring to FIG. 7, due to the negative pressure inside the mini nozzle 40, outer air on the floor is sucked through the suction hole Si together with foreign particles. Of course, when the suction hole 51 is blocked, the outer air can be sucked through the first and second bypass channels 50 and 49 such that over heating of the vacuum cleaner can be prevented. In addition, since the brush of the agitator 44 is at least partially protruded toward an outer direction of the suction hole 51, the floor is scratched while the agitator 44 rotates to float the foreign particles from the floor such that the foreign particles on the floor can be smoothly sucked.

The air sucked through the suction hole 51 is introduced into the turbine receiving portion 48 via the suction passage 52. At this time, the air that has passed through the suction passage 52 collides with the turbine 46 to rotate the turbine 46. As aforementioned, as the turbine 46 rotates, the agitator 44 connected with the turbine 46 by the belt 45 rotates forcibly.

In the meanwhile, though the agitator 44 can float the foreign particles from the floor, turbulent flow is generated around the agitator 44 by the rotation of the agitator 44. To this end, there may occur a phenomenon that around the agitator 44, air is not sucked into the suction passage 52 but rotates. Further, the air rotating around the agitator 44 contains foreign particles. Thus, the foreign particles rotating around the agitator 44 are adhered to several places of the inside of the mini nozzle 40, which acts as a reason that the mini nozzle 40 is contaminated. Also, the foreign particles may be discharged to the outside of the mini nozzle 40 through the suction hole 51 during their rotation. Thus, to prevent the foreign particles from rotating unnecessarily, the foreign particle rotation-preventing portion 53 is formed long at a front side of the air guide 54.

The foreign particles rotating around the agitator 44 by the foreign particle rotation-preventing portion 53 collide with a lower side of the foreign particle rotation-preventing portion 53, so that the rotation speed of the foreign particles is reduced or the rotation of the foreign particles stop and whereby the foreign particles can be smoothly sucked toward the suction passage 52. In particular, since the foreign particles sucked together with air is heavy compared with the air, the air rotates along an outer circumference distanced from a center of the agitator 44. From the above fact, it can be readily presumed that the rotation of the foreign particles can stop.

In another aspect of the present invention, when the agitator 44 rotates, the brush of the agitator 44 brushes off the foreign particles by contacting the foreign particles with the foreign particle rotation-preventing portion 53. Accordingly, the foreign particles adhered to the brush by the static electricity can be smoothly brushed off. Of course, the suction efficiency of the foreign particles can be enhanced because the foreign particles are detached from the brush.

Figure 8:
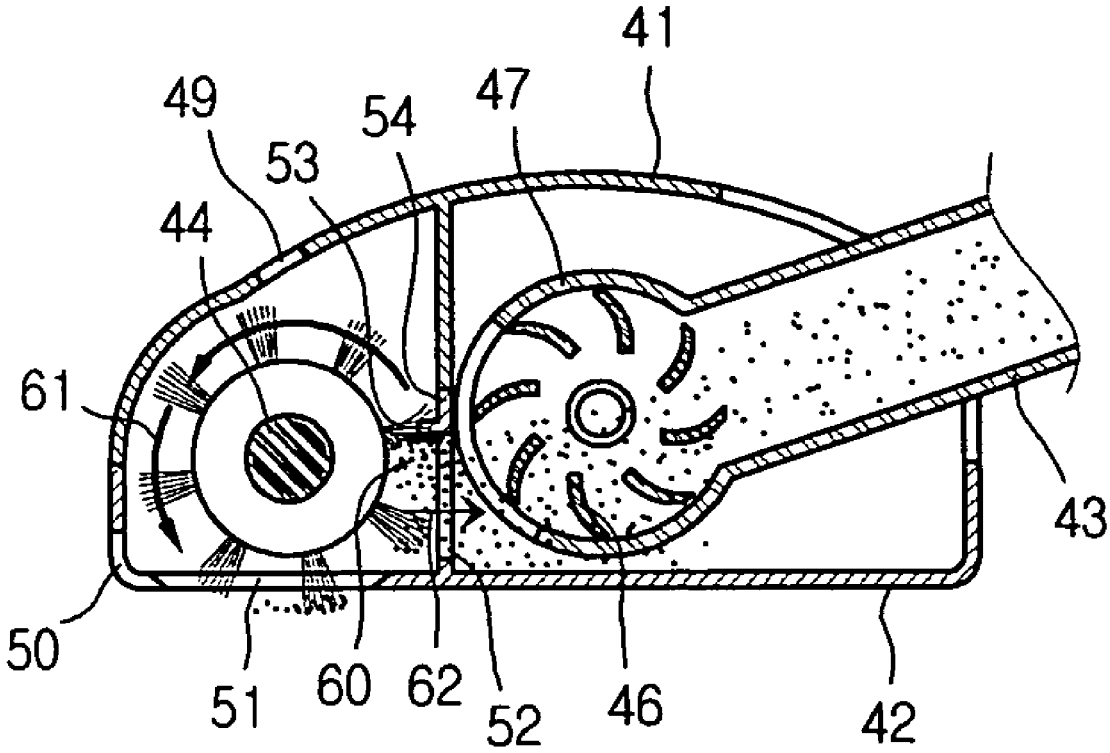
FIG. 8 is a schematic view illustrating a movement of air and foreign particles inside a mini nozzle.

FIG. 8 illustrates movement of air and foreign particles flowing in the mini nozzle.

Referring to FIG. 8, air sucked through the suction hole 51 forms an air rotation passage 61 rotating around the agitator 44. The foreign particles 60 are pushed outward by a centrifugal force and collide with the foreign particle rotation-preventing portion 53. To this end, the foreign particles are not smoothly sucked along the air rotation passage 61 but is smoothly sucked along the suction passage 52 to form a foreign particle passage 62.

The foreign particle rotation-preventing portion 53 may be a rib formed in a lateral direction from an upper side of the air guide 54. Preferably, the foreign particle rotation-preventing portion 53 is designed to be protruded toward a center of the agitator 44 such that the foreign particles are smoothly filtered in the air rotation passage 61. It can be apparently understood that if the foreign particle rotation-preventing portion 53 is made in the form of a blocking film protruded from the air guide 54, the same effect can be obtained.

Next, experiments for verifying the effect of the foreign particle rotation-preventing portion 53 will be described.

In the experiments, a carpet having a size of 178 mm.times.178 mm was prepared and 20 grams fine powder of silica sand was sprayed on the carpet. Amounts of foreign particles sucked were measured with respect to an experiment example (e.g., suction nozzle having the foreign particle rotation-preventing portion) and a comparative example (e.g., suction nozzle not having the foreign particle rotation-preventing portion) while operating the experimental example and the comparative example 16 times in forward and backward direction. The experiments were repeated three times. Below table 1 shows results obtained by the above experiments.

TABLE 1

| | 1st suction amount (g) | 2nd suction amount (g) | 3rd suction amount (g) | Average suction rate (g) |
|---|---|---|---|---|
| Comparative Example | 10.4 | 12.1 | 11.9 | 57.3 |
| Experimental Example | 16.4 | 14.5 | 14.9 | 76.3 |

From the experimental results shown in table 1, it can be known that the suction amount of the foreign particles in the experimental example is increased by about 20% than that in the comparative example, i.e., the cleaning efficiency in the experimental example is higher than that in the comparative example. In the above experiments, the experimental example and the comparative example have only one difference that the experimental example has the foreign particle rotation-preventing portion and the comparative example does not have the foreign particle rotation-preventing portion but they are the same in other conditions.

While the foreign particle rotation-preventing portion according to the spirit of the present invention is described with the example of the mini nozzle of the upright vacuum cleaner, it is not limited thereto. Though the foreign particle rotation-preventing portion is employed in other type of vacuum cleaner or a suction nozzle having a general size, the same effect can be obtained.

By employing the suction nozzle according to the present invention, foreign particles do not rotate in the suction nozzle but are sucked into the suction nozzle, so that the cleaning efficiency is increased as much.

Also, since the suction efficiency of foreign particles, further, efficiency of the vacuum cleaner can be improved by a simple mechanical construction, convenience and energy consumption efficiency can be enhanced.

Further, since foreign particles are smoothly discharged without accumulation in the suction nozzle, cleanness inside the suction nozzle can be enhanced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A suction nozzle structure of a vacuum cleaner, comprising:

a suction tube in which a negative pressure is formed;

an upper cover;

a lower cover positioned adjacent to the upper cover and in communication with the suction tube;

a suction hole formed at a bottom of the lower cover such that air and foreign particles are sucked therethrough by the negative pressure of the suction tube;

an agitator installed at an upper side of the suction hole;

an air guide that guides an air flow, provided with an air suction passage communicating the suction hole with the suction tube; and a foreign particle rotation-preventing portion formed protruding from the air guide that prevents foreign particles from rotating above the foreign particle rotation-preventing portion.

2. The suction nozzle structure according to claim 1, wherein the foreign particle rotation-preventing portion is formed extending in a lateral direction.

3. The suction nozzle structure according to claim 1, wherein the foreign particle rotation-preventing portion protrudes toward the agitator.

4. The suction nozzle structure according to claim 1, wherein the foreign particle rotation-preventing portion is formed at an upper side of the air suction passage.

5. The suction nozzle structure according to claim 1, wherein the foreign particle rotation-preventing portion extends horizontally from the air guide.

6. The suction nozzle structure according to claim 1, further comprising:

a turbine housing formed integrally with the suction tube in front of the suction tube; and a turbine received in the turbine housing that rotates when it collides with the air flow.

7. The suction nozzle structure according to claim 1, wherein the air guide is bent backward to guide the air flow.

8. The suction nozzle structure according to claim 1, wherein the agitator comprises a brush that contacts with the foreign particle rotation-preventing portion.

9. The suction nozzle structure according to claim 1, further comprising at least one bypass channel through which air is sucked when the suction hole is blocked.

10. A vacuum cleaner comprising the suction nozzle structure of claim 1.

11. A vacuum cleaner, comprising:

a suction nozzle through which air is sucked into the vacuum cleaner;

a body that receives a dust collecting device through which foreign particles introduced through the suction nozzle are filtered;

a hose that connects the suction nozzle with the body to guide an air flow;

a handle formed on an upper portion of the body configured to allow a user to manipulate the vacuum cleaner;

a mini nozzle selectively connected to the hose configured to be used for cleaning;

a mini nozzle seat concavely formed at a predetermined portion of the body configured to selectively receive the mini nozzle therein;

an agitator installed in the mini nozzle that agitates foreign particles from a floor by rotation thereof; and a foreign particle rotation-preventing portion that extends toward the agitator such that the foreign particles received in a rotational turbulent flow around the agitator are prevented from rotating beyond the foreign particle rotation-preventing portion.

12. The vacuum cleaner according to claim 11, wherein the foreign particle rotation-preventing portion protrudes from an air guide formed in the mini nozzle to guide the air flow.

13. The vacuum cleaner according to claim 11, wherein the mini nozzle comprises:

a turbine that rotates while colliding with the air flow; and a belt that connects the turbine with the agitator so as to rotate the agitator.

14. The vacuum cleaner according to claim 11, wherein the foreign particle rotation-preventing portion extends toward a center of the agitator to reduce the rotational turbulent flow formed around the agitator.

15. The vacuum cleaner according to claim 11, wherein the rotational turbulent flow is reduced by the foreign particle rotation-preventing portion.

16. The vacuum cleaner according to claim 11, wherein the foreign particle rotation-preventing portion contacts at least a portion of the agitator to clear dust off the foreign particle rotation-preventing portion and the agitator.

17. The vacuum cleaner according to claim 11, wherein the foreign particle rotation-preventing portion is formed on a lower cover of the mini nozzle.

18. A suction nozzle structure of a vacuum cleaner, comprising:

an upper cover and a lower cover that form an outer shell of a mini nozzle;

an agitator receiving portion in which an agitator is received that agitates foreign particles from a floor;

a turbine receiving portion formed at a rear side of the agitator receiving portion in which a turbine is received that is rotated by an air flow;

an air guide that partitions an inner space of the mini nozzle into the agitator receiving portion and the turbine receiving portion and guides air sucked by the agitator receiving portion to the turbine receiving portion; and a foreign particle rotation-preventing portion formed protruding from the air guide that prevents the foreign particles from rotating beyond the foreign particle rotation-preventing portion.

19. The suction nozzle structure according to claim 18, wherein the foreign particle rotation-preventing portion is formed extending in a lateral direction.

20. The suction nozzle structure according to claim 18, wherein the foreign particle rotation-preventing portion reduces a turbulent flow formed around the agitator.

21. The suction nozzle structure according to claim 18, wherein the foreign particle rotation-preventing portion contacts at least a portion of the agitator.

22. The suction nozzle structure according to claim 18, wherein the agitator agitates the foreign particles in an upward direction.

23. A vacuum cleaner comprising the suction nozzle structure of claim 18.

* * * * *